US006550301B2

(12) United States Patent
Hasegawa

(10) Patent No.: US 6,550,301 B2
(45) Date of Patent: Apr. 22, 2003

(54) METHOD FOR PRODUCING AN INCLINED HELICAL SPRING

(75) Inventor: Keiji Hasegawa, Toyoake (JP)

(73) Assignee: Chuo Hatsujo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/915,272

(22) Filed: Jul. 27, 2001

(65) Prior Publication Data

US 2002/0011090 A1 Jan. 31, 2002

(30) Foreign Application Priority Data

Jul. 31, 2000 (JP) ..... 2000-231184

(51) Int. Cl.[7] ..... B21F 3/10
(52) U.S. Cl. ..... 72/138; 276/180; 29/896.9
(58) Field of Search ..... 72/138, 137, 134; 267/180, 166, 179; 29/896.9

(56) References Cited

U.S. PATENT DOCUMENTS 1,017,919 A * 2/1912 Sanders ..... 267/166
1,867,723 A * 7/1932 Adams ..... 267/179
6,328,290 B1 * 12/2001 Imaizumi et al. ..... 267/179
6,375,174 B2 * 4/2002 Hasegawa et al. ..... 267/166
6,481,701 B2 * 11/2002 Kessen et al. ..... 267/166

FOREIGN PATENT DOCUMENTS

GB 1192766 * 7/1967 ..... B60G/3/04
GB 1192766 5/1970

OTHER PUBLICATIONS

U.S. patent application Ser. No. 09/767,267 Hasegawa et al., filed Jan. 23, 2001.

* cited by examiner

*Primary Examiner*—Allen Ostrager
*Assistant Examiner*—John Goetz
(74) *Attorney, Agent, or Firm*—Oliff & Berridge PLC

(57) ABSTRACT

The present invention is directed to an inclined helical spring having a plurality of coils along an inclined coil axis. Each coil constituting a part or the whole length of the helical compression spring is increased and decreased in diameter along the longitudinal axis of the spring, and forming the longitudinal axis of the spring in a free state thereof to be inclined substantially at a predetermined angle to an axis to be mounted with the spring. For example, one section of each coil having approximately a half of the circumference of each coil, which is divided by a plane including the coil axis, is increased in diameter, whereas the other one section of approximately a half of the circumference of each coil is decreased in diameter. The inclined helical spring may be mounted on a vehicle suspension.

4 Claims, 6 Drawing Sheets

METHOD FOR PRODUCING AN INCLINED HELICAL SPRING

BACKGROUND OF THE INVENTION

1. Field of the Invention

The present invention relates to a method for producing an inclined helical spring, and more particularly to the method for producing the inclined helical spring for use in a strut type vehicle suspension.

2. Description of the Related Arts

Various types of helical compression spring have been known heretofore. Among them, a compression spring having an inclined coil axis has been known. In British Patent No. 1192766 for example, proposed are improvements in or relating to vehicle wheel suspension assemblies. The British Patent discloses a helical spring which is coiled in the untensioned state with transverse relative displacement of the turns, and when mounted is stressed by lateral relative displacement of the turns of the spring out of the unstressed position thereof to apply a bending moment to the shock absorber in opposition to the bending moment applied by a wheel support.

In the British Patent, with respect to the compression helical spring having an inclined coil axis, i.e., inclined helical spring, its structure and a method for producing it have not been described. If the inclined helical spring is produced by a cold working according to a conventional process for producing a substantially cylindrical helical spring, it is assumed that the spring is produced by changing the pitch of its coil end portion. According to the produced compression spring, however, its neighboring coils are likely to contact each other, so that it is almost impossible to obtain a desired spring characteristic. On the other hand, as for another conventional method for producing a spring, a hot working has been known heretofore, whereby it is possible to produce the inclined helical spring without changing the pitch.

When the inclined helical spring is produced by the hot working, the coil wire may be wound according to the processes as shown in FIGS. 10–12. That is, by holding one end of a coil wire HW, which was heated up to a certain temperature to be deformed thermally, on an end of a mandrel 202 by a pressing member 201, and drawing the coil wire HW by a lead roller 203 in a predetermined direction so as to wind it around the mandrel 202, the inclined helical spring 50 as shown in FIG. 12 can be formed. In this case, the lead roller 203 is set to provide a larger inclined angle $\theta 1$ for a half of a coil as shown in FIG. 10, and provide a smaller inclined angle $\theta 2$ for a half of a coil followed by the half coil as shown in FIG. 11. Therefore, the diameter D1 of the half coil as shown in FIG. 10 is larger than the diameter D2 of the half coil as shown in FIG. 11. Therefore, by repeating the processes as shown in FIGS. 10 and 11 according to a half coil cycle, can be produced the inclined spring 50 having the coil axis inclined at the angle $\alpha$ to the opposite end faces, as shown in FIG. 12.

According to the method for producing the inclined helical spring by the hot working as described above, however, not only a large plant including a heating apparatus is needed, but also the angles $\theta 1$ and $\theta 2$ are likely to be varied, thereby requiring a time for checking its characteristic. Also, it is not easy to obtain a desired side force, because its shape is varied by spring-back. In the mean time, there exists a helical spring that is formed to vary a diameter of each coil along the coil axis, such as a truncated cone-shaped helical spring, a barrel-shaped helical spring, or the like. However, it is hardly considered that someone will employ a helical spring having a varying diameter of each coil, with its coil axis inclined, for the helical compression spring as disclosed in the British patent.

SUMMARY OF THE INVENTION

Accordingly, it is an object of the present invention to provide a method for producing an inclined helical spring easily by cold working, without a heating process required for forming the spring.

In accomplishing the above and other objects, a method for producing an inclined substantially cylindrical helical spring having a plurality of substantially circular coils along an inclined coil axis, includes the steps of forming each substantially circular coil constituting a predetermined portion of the substantially cylindrical helical spring between one end and the other one end of the spring to be increased and decreased in diameter successively along the longitudinal axis of the spring, with a half section of the coil increased or decreased in diameter compared with a diameter of a preceding or subsequent half section of the coil; and forming the longitudinal axis of the spring in a free state of the of the spring to be inclined substantially at a predetermined angle to an axis to be mounted with the spring.

Or, the method for producing the substantially cylindrical inclined helical spring may include the steps of forming each substantially circular coil constituting a substantially circular helical spring of the whole length thereof between one end and the other end of the spring to be increased and decreased in diameter successively along the longitudinal axis of the spring, with a half section of the coil increased or decreased in diameter compared with a diameter of a preceding or subsequent half section of the coil; and forming the longitudinal axis of the spring to be inclined substantially at a predetermined angle to an axis to be mounted with the spring.

In the methods as defined above, preferably each coil is formed with one section having approximately a half of the circumference of each coil divided by a plane including the coil axis is formed to be increased or decreased in diameter, and the other one section followed by the one section having approximately a half of the circumference of each coil is formed to be decreased or increased in diameter.

BRIEF DESCRIPTION OF THE DRAWINGS

The above stated object and following description will become readily apparent with reference to the accompanying drawings, wherein like reference numerals denote like elements, and in which.

DESCRIPTION OF THE PREFERRED EMBODIMENTS

Figure 1:
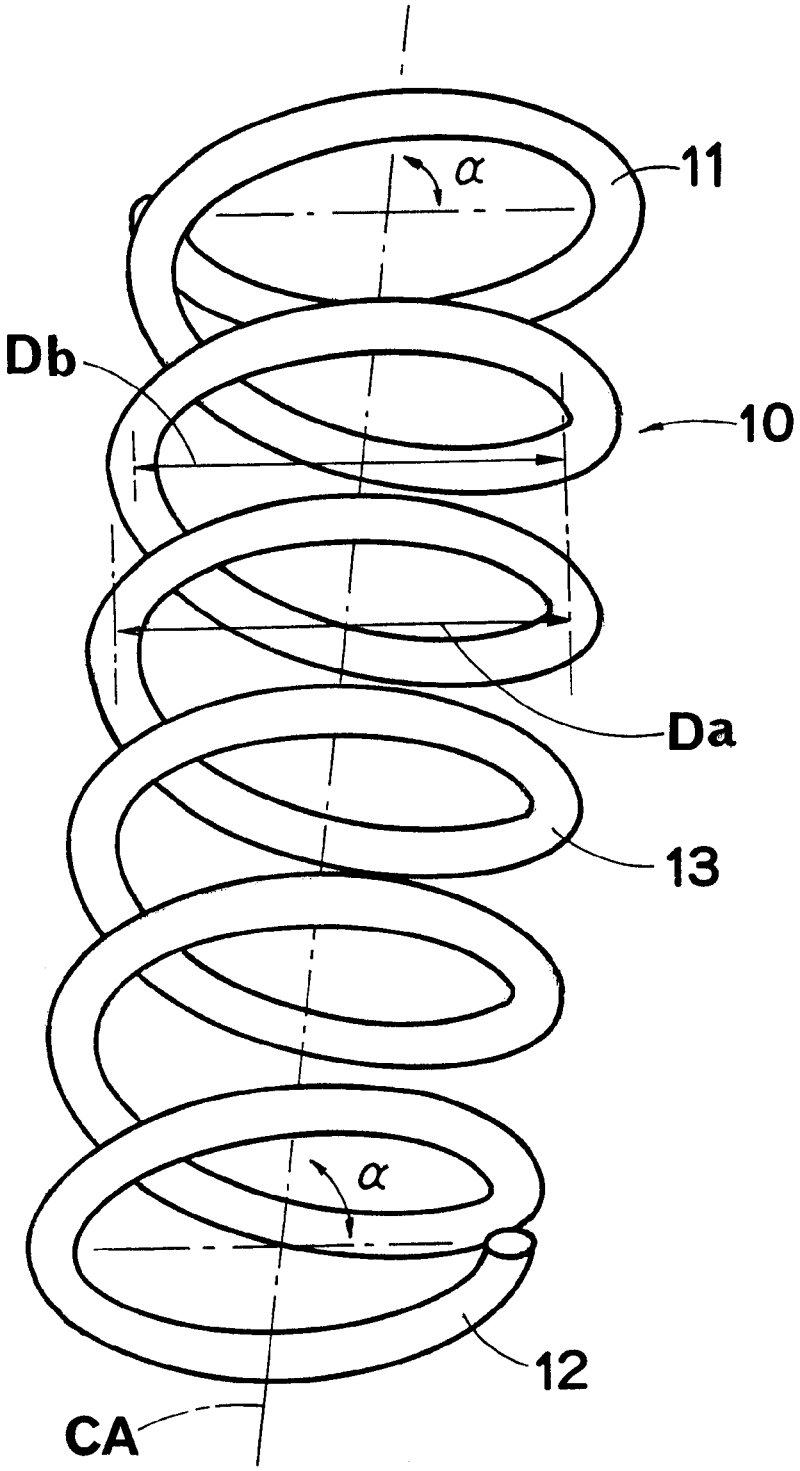
FIG. 1 is a perspective view of an inclined helical spring of an embodiment produced according to a method of the present invention.

Referring to FIG. 1, there is schematically illustrated an inclined helical spring produced according to a method for producing the same of the present invention. The inclined helical spring 10 according to the present embodiment has a body portion 13 between an upper end coil 11 and a lower end coil 12, with a coil axis CA of the body portion 13 inclined at an angle $\alpha$ to the upper end coil 11 and lower end coil 12, and formed at a substantially constant pitch. In this case, each coil constituting the body portion 13 according to the present embodiment is increased and decreased in diameter in accordance with the number of coils, i.e., along the axis.

In practice, the diameter of one coil of the body portion 13 is set in such a manner that one section of the one coil having approximately a half of the circumference of the one coil divided by a plane including the coil axis CA is gradually increased in diameter from its local minimum diameter (Db) in the one coil, and reaches its local maximum diameter (Da) in the one coil, and that the other one section following that one section having approximately a half of the circumference of the one coil is gradually decreased from the local maximum diameter (Da), and reaches the local minimum diameter (Db) in the one coil.

According to the present embodiment, the upper end coil 11 and the lower end coil 12 are set to be of approximately the same diameter as the portion of the local minimum diameter, while they are not limited to that dimension. The local maximum diameter (Da) and the local minimum diameter (Db) indicate the local maximum value and the local minimum value in each one coil (or, one turn). According to the present embodiment, they are set to be of different values by each one coil according to a desired configuration. Thus, the local maximum diameter (Da) and the local minimum diameter (Db) are set to be of different values in the longitudinal direction (by the number of coils), respectively. The relationship in one coil as increased and decreased in diameter is held to be of a predetermined relationship.

Figure 2:
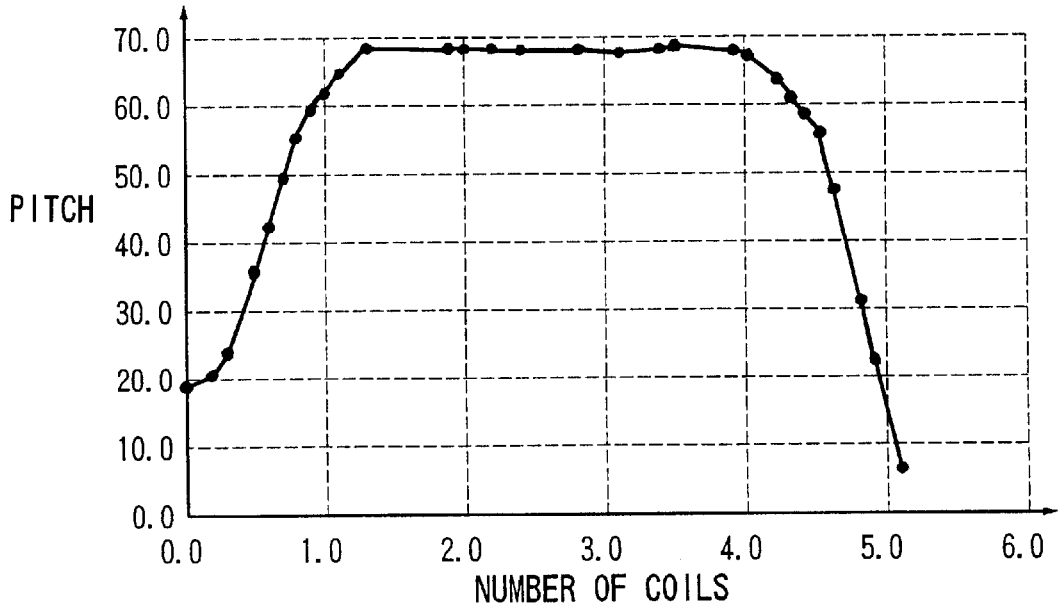
FIG. 2 is a diagram showing a relationship between the number of coils and pitches of an inclined helical spring produced according to an embodiment of the present invention.
Figure 3:
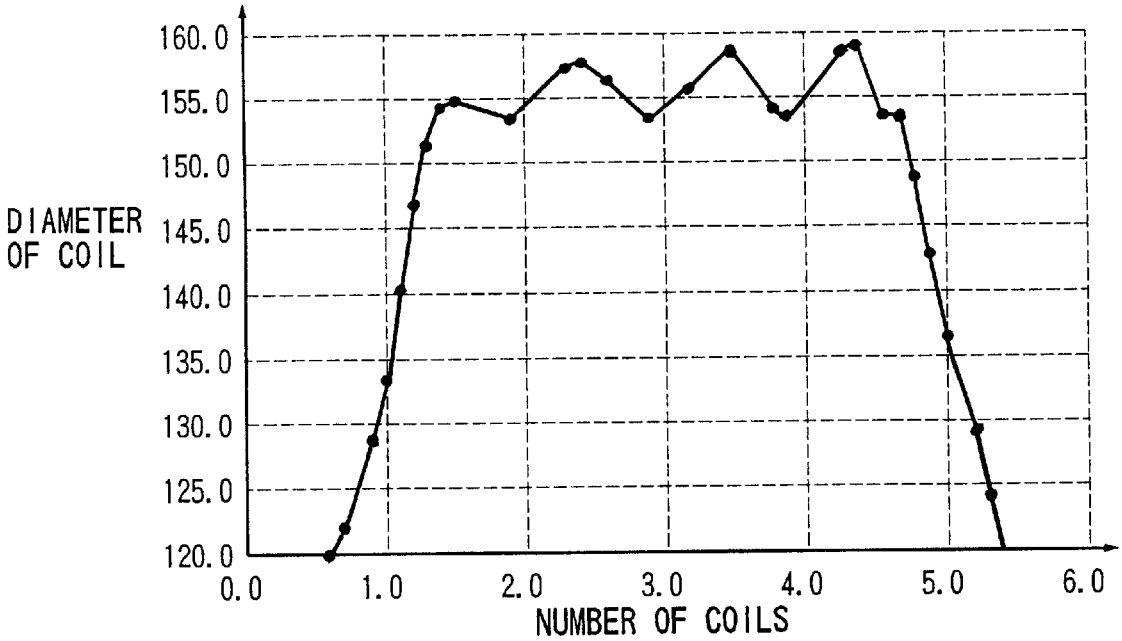
FIG. 3 is a diagram showing a relationship between the number of coils and diameters of coils of an inclined helical spring produced according to an embodiment of the present invention.
Figure 4:
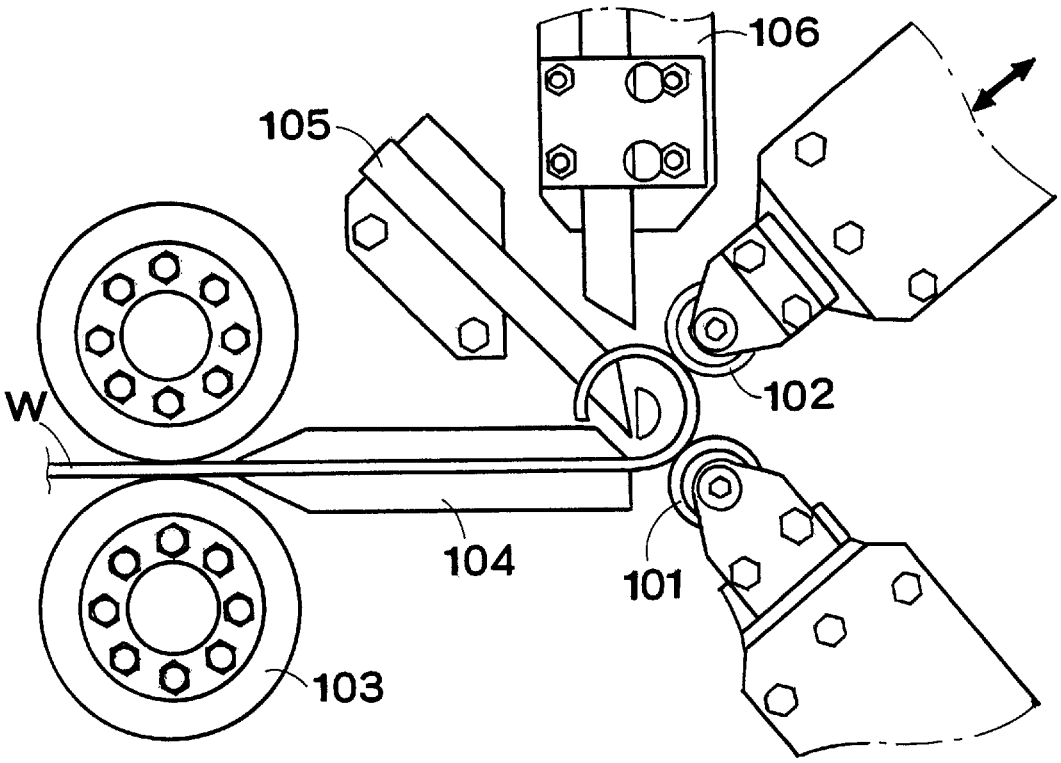
FIG. 4 is a front view of a coiling machine for producing an inclined helical spring according to an embodiment of the present invention.

FIG. 4 illustrates a part of a coiling machine for producing the inclined helical spring 10 as described above, wherein a basic structure is the same as those distributed in the market. According to the present embodiment, a couple of coiling pins of a first pin 101 and a second pin 102 are provided, and the second pin 102 is adapted to move toward and away from a center of each coil to be formed, as indicated by a two-way arrow, so as to adjust the diameter of the coil. And, the pitch and diameter of the coil as shown in FIGS. 2 and 3 are stored in a program in advance by a numerical control machine (not shown), so that the coiling machine is actuated according to the program. According to a rotation of a feed roller 103, therefore, an element wire of the coil (hereinafter, referred to as wire W) is guided by a wire guide 104 and delivered rightward in FIG. 4. Then, the wire W is bent by the first pin 101, and bent by the second pin 102 to be coiled in a predetermined diameter. During this process, pitches between neighboring coils are controlled to be of a constant value by a pitch tool 105. When the wire W is coiled to provide a predetermined number of coils, it is cut by a cutter 106. Although the first and second pins 101, 102 are employed in the present embodiment, a single coiling pin may be employed.

Figure 5:
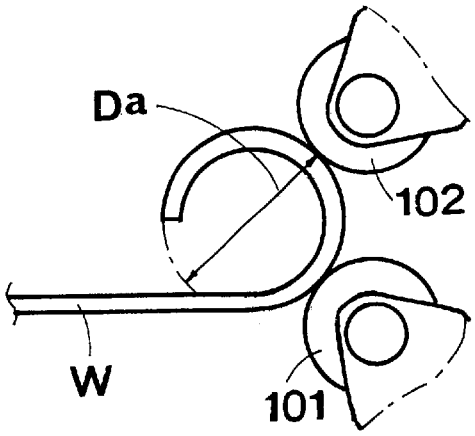
FIG. 5 is a front view showing one process for producing an inclined helical spring according to an embodiment of the present invention.
Figure 6:
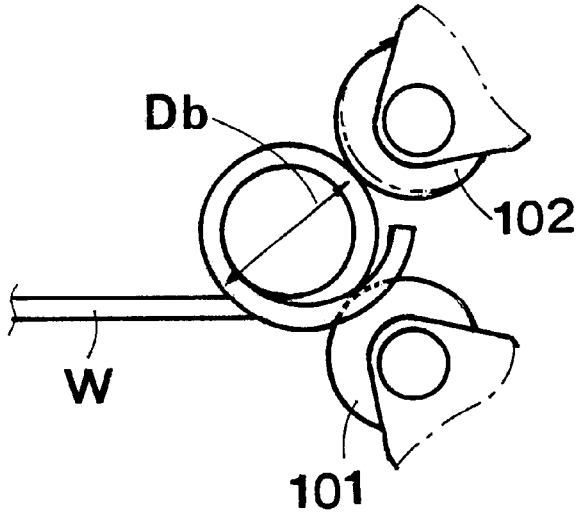
FIG. 6 is a front view showing another process for producing an inclined helical spring according to an embodiment of the present invention.

When the inclined helical spring 10 is produced by the coiling machine as described above, the first and second pins 101 and 102 are actuated as follows. At the outset, it is so arranged that the diameter of a section extending from [a reference position −½ of one coil] to [the reference position], wherein the reference position of each coil is placed in one end of the inclined helical spring to be formed, i.e., the diameter of one section of each coil having approximately a half of the circumference of each coil divided by a plane including the coil axis (i.e., the plane including the reference position, and perpendicular to a drawing plane of FIG. 4) is increased in diameter. In this case, the wire W is bent by the first and second pins 101 and 102, with the second pin 102 being retracted, and formed to gradually increase the diameter of the coil up to the local maximum diameter (Da) as shown in FIG. 5. Then, it is so arranged that the diameter of a section following the above-described section having approximately a half of the circumference of each coil, i.e., the diameter of a section extending from [the reference position] to [the reference position +½ of one coil] is decreased in diameter. In this case, the wire W is bent, with the second pin 102 being advanced, and formed to gradually decrease the diameter of the coil down to the local minimum diameter (Db) as shown in FIG. 6.

Figure 7:
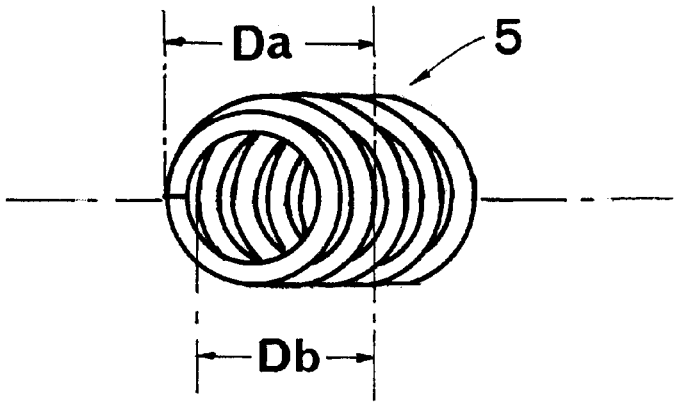
FIG. 7 is a plan view showing an example of a part of an inclined helical spring under a coiling process according to an embodiment of the present invention.

Likewise, the next section of approximately a half of the circumference of the coil is bent, with the second pin 102 being retracted, until it becomes to be of the local maximum diameter (Da). And, the following section of approximately a half of the circumference of the coil is bent, with the second pin 102 being advanced, until it becomes to be of the local minimum diameter (Db). Then, the diameter of each one coil is set to be varied according to the order of increasing the diameter and then decreasing the diameter of each one coil, up to the other end of the body portion 13 to be formed, as shown in FIG. 7. Accordingly, if the diameter of the coil is set as shown in FIG. 3 for example, and the coiling is made by the advancing movement and retracting movement of the second pin 102 repeated alternately, by each approximately half portion of the circumference of the coil, then the inclined helical spring 10 having the inclined coil axis, such as the coil axis CA inclined to the opposite end faces as shown in FIG. 1, will be formed.

According to the present embodiment, the portion of increasing the diameter and decreasing the diameter of each one coil is formed along the whole length from one end to the other one end of the helical spring, while it may be formed on the predetermined portion between the one end and the other one end of the spring. For example, only the body portion without the upper end coil at its one end and the lower end coil at its the other one end may be provided as the portion of increasing the diameter and decreasing the diameter of each one coil, to produce the inclined helical spring having the longitudinal axis of the spring in a free state thereof to be inclined substantially at a predetermined angle to an axis to be mounted with the spring. Also, the local maximum diameter (Da) and the local minimum diameter (Db) may be set in each half circumference portion, and they may be set to be of a constant value, or may be set to be varied in the longitudinal direction, the latter of which may result in an inclined and slightly curved axis.

Figure 8:
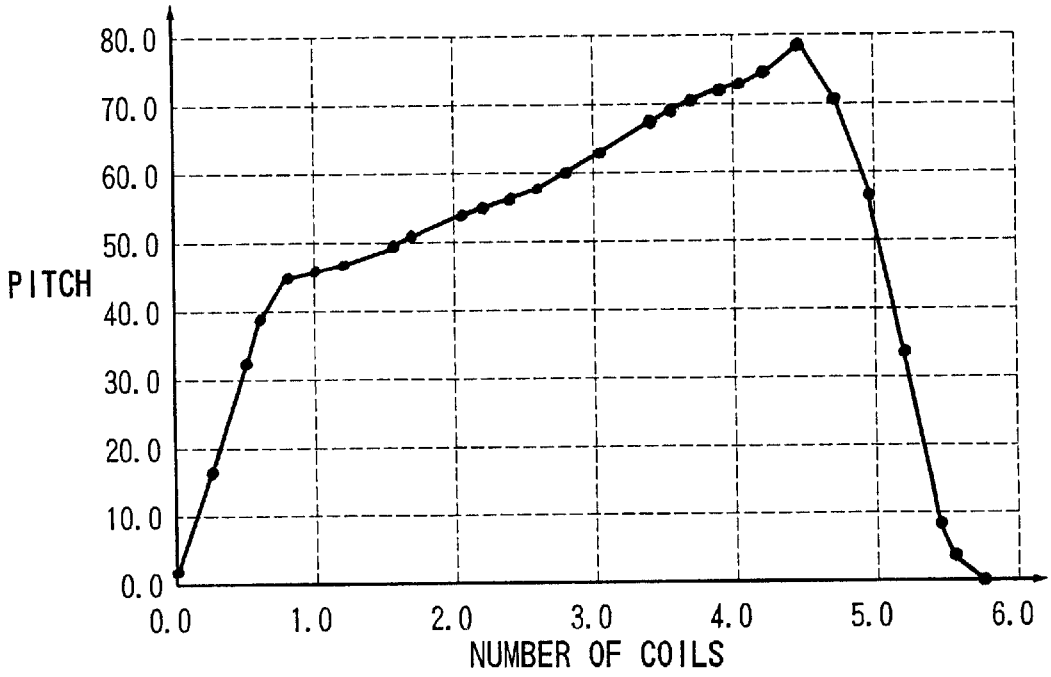
FIG. 8 is a diagram showing a relationship between the number of coils and pitches of the inclined helical spring produced according to another embodiment of the present invention.
Figure 9:
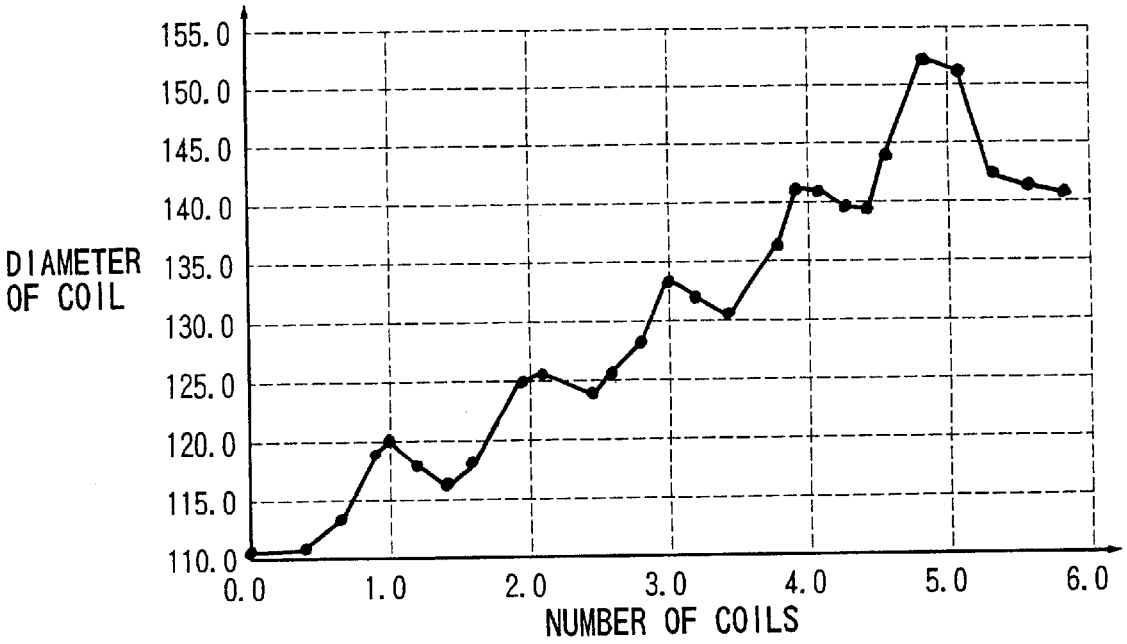
FIG. 9 is a diagram showing a relationship between the number of coils and diameters of coils of the inclined helical spring produced according to another embodiment of the present invention.
Figure 10:
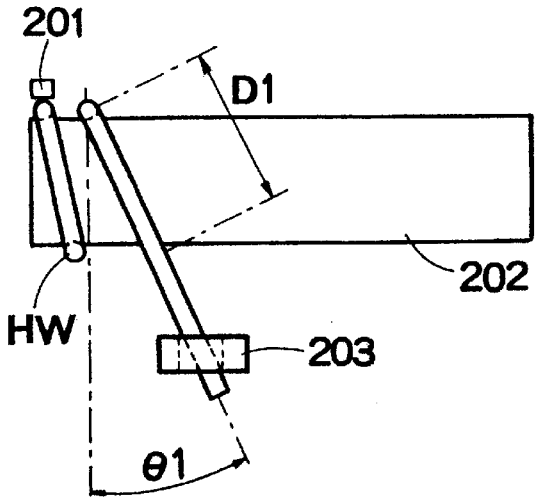
FIG. 10 PRIOR ART
FIG. 10 is a front view showing a process in a method for producing an inclined helical spring according to hot working.
Figure 11:
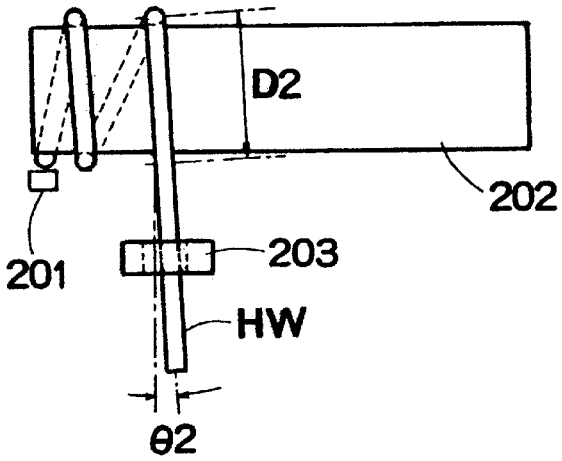
FIG. 11 PRIOR ART
FIG. 11 is a front view showing another process in a method for producing an inclined helical spring according to hot working.
Figure 12:
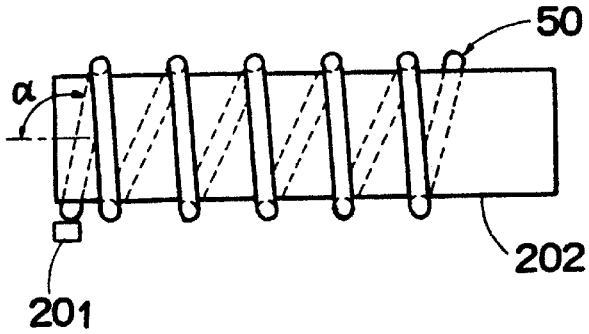
FIG. 12 PRIOR ART
FIG. 12 is a front view showing a further process in a method for producing an inclined helical spring according to hot working, and a finished shape of the inclined helical spring.

Next, FIGS. 8 and 9 illustrate an inclined helical spring (not shown) according to another embodiment of the present invention, wherein the spring is formed in a truncated cone-shape with an inclined coil axis. According to this embodiment, the pitch is provided so as to be increased in proportion to the number of coils, as shown in FIG. 8. However, the variation of the pitch is caused by forming the configuration of the spring to be the conical shape, so that it is provided as an independent condition, without any relationship with forming the coil axis to be inclined. Also, FIG. 9 shows a graph in which the diameter of the coil is increased in proportion to the number of coils, this variation is also caused by forming the configuration of the spring to be the truncated cone-shape, so that it is provided without any direct relationship with forming the coil axis to be inclined. In order to incline the coil axis, however, the diameter of the coil is gradually increased along the longitudinal axis, maintaining a relative relationship between the diameters of the approximately halves of circumferences in one coil. Thus, in the case where the spring is formed to provide a specific configuration, the pitch is to be varied, or the diameter of the coil is to be varied. In this case, in order to provide an inclined coil axis, the relative relationship in magnitude between the diameters of the approximately halves of circumferences in one coil has to be maintained.

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. A method for producing an inclined substantially cylindrical helical spring having a plurality of substantially circular coils along an inclined coil axis, comprising:

forming each substantially circular coil constituting a predetermined portion of the substantially cylindrical helical spring between one end and the other end thereof to be increased and decreased in diameter successively along the longitudinal axis of the spring with a half section of the coil increased or decreased in diameter compared with a diameter of either a preceding or subsequent half section of the coil; and forming the longitudinal axis of the spring in a free state thereof to be inclined substantially at a predetermined angle to an axis to be mounted with the spring.

2. The method for producing the inclined substantially cylindrical helical spring of claim 1, further comprising forming each substantially circular coil constituting the predetermined portion of the spring by:

forming an increased diameter half section of the substantially circular coil, the half section defined by approximately a half of the circumference of each coil divided by a plane including the coil axis, wherein the increased diameter half section of the substantially circular coil is characterized by an increased diameter compared with the diameter of either the preceding or the subsequent half section of the substantially circular coil; and forming a decreased diameter half section of the substantially circular coil, the half section defined by approximately half of the circumference of the substantially circular coil divided by a plane including the coil axis, wherein the decreased diameter half section of the substantially circular coil is characterized by a decreased diameter when compared with the diameter of either the preceding or the subsequent half section of the substantially circular coil.

3. A method for producing an inclined substantially cylindrical helical spring having a plurality of substantially circular coils along an inclined coil axis, comprising:

forming each substantially circular coil constituting the substantially cylindrical helical spring of the whole length thereof between one end and the other one end of the spring to be increased and decreased in diameter successively along the longitudinal axis of the spring, with a half section of the substantially circular coil increased or decreased in diameter compared with a diameter of either a preceding or subsequent half section of the substantially circular coil; and forming the longitudinal axis of the spring in a free state thereof to be inclined substantially at a predetermined angle to an axis to be mounted with the spring.

4. The method for producing the inclined substantially cylindrical helical spring of claim 3, further comprising forming each one of the plurality of substantially circular coils by:

forming an increased diameter half section of the substantially circular coil, the half section defined by approximately a half of the circumference of the substantially circular coil divided by a plane including the coil axis, wherein the increased diameter half section of the substantially circular coil is characterized by an increased diameter compared with the diameter of either the preceding or the subsequent half section of the substantially circular coil; and forming a decreased diameter half section of the substantially circular coil, the half section defined by approximately half of the circumference of the substantially circular coil divided by a plane including the coil axis, wherein the decreased diameter half section of the substantially circular coil is characterized by a decreased diameter when compared with the diameter of either the preceding or the subsequent half section of the substantially circular coil.

* * * * *